United States Patent [19]

Gerber

[11] Patent Number: 4,697,400

[45] Date of Patent: Oct. 6, 1987

[54] APPARATUS FOR STORING PRINTED PRODUCTS ARRIVING IN AN IMBRICATED FORMATION

[75] Inventor: Walter Gerber, Hinwil, Switzerland

[73] Assignee: Ferag AG, Hinwil, Switzerland

[21] Appl. No.: 941,855

[22] Filed: Dec. 15, 1986

[30] Foreign Application Priority Data

Dec. 20, 1985 [CH] Switzerland ..... 05471/85

[51] Int. Cl.[4] ..... B65B 63/04

[52] U.S. Cl. ..... 53/118; 242/59

[58] Field of Search ..... 53/118, 117, 116, 430, 53/399, 587; 414/88; 242/59, 67.1 R, 56 R, 55.42

[56] References Cited

U.S. PATENT DOCUMENTS

| | | | |
|---|---|---|---|
| 3,310,167 | 3/1967 | Knox | 242/55.42 |
| 4,062,537 | 12/1977 | Dietrich | 414/88 X |
| 4,274,623 | 6/1981 | Reist et al. | 414/88 X |
| 4,580,739 | 4/1986 | Linder | 242/59 |
| 4,582,271 | 4/1986 | Takahashi | 242/105 X |
| 4,637,198 | 1/1987 | Gerber | 53/430 |

FOREIGN PATENT DOCUMENTS

| | | | |
|---|---|---|---|
| 2207556 | 8/1973 | Fed. Rep. of Germany | 242/59 |

*Primary Examiner*—James F. Coan

*Attorney, Agent, or Firm*—Werner W. Kleeman

[57] ABSTRACT

A plurality of similar winding units which are independently rotatably mounted are arranged in vertical superposition on a common support column. Each winding unit comprises a substantially horizontal discoidal support element or plate. Connected thereto is a substantially annular winding drum or mandrel or core. A conveyor delivers the printed products to be wound upon the winding cores. The conveyor comprises an exit or discharge region which is adjustable in height or elevation. A turning device is located adjacent to this discharge region and, together with the discharge region, is adjustable in elevation or height for uprighting or raising into a vertical position the reclining imbricated formation of incoming printed products. Subsequent to the uprighting of the printed products, the printed products are guided to the winding core or the respective wound product package or storage coil formed thereon by means of a pivotable rocker conveyor and are wound or coiled up. The winding units can be individually supplied with printed products and these printed products can also again be individually withdrawn or unwound from these winding units.

16 Claims, 6 Drawing Figures

APPARATUS FOR STORING PRINTED PRODUCTS ARRIVING IN AN IMBRICATED FORMATION

CROSS-REFERENCE TO RELATED APPLICATION

The present invention is related to my commonly assigned, co-pending U.S. patent application Ser. No. 06/877,130, filed June 23, 1986 and entitled "METHOD AND APPARATUS FOR TEMPORARILY STORING PRINTED PRODUCTS ARRIVING IN AN IMBRICATED FORMATION", the disclosure of which is incorporated herein by reference.

BACKGROUND OF THE INVENTION

The present invention broadly relates to a new and improved apparatus for storing printed products or the like arriving in an imbricated formation.

Generally speaking, the apparatus of the present invention comprises a plurality of support means or discoidal support elements or plates for supporting the printed products arriving in an imbricated formation. This plurality of support means is rotatable about an upright and preferably substantially vertical axis. A conveying or infeed arrangement defining a delivery arrangement is provided for infeeding or delivering the printed products to the plurality of support means.

It is known to the art for printed products arriving in a reclining imbricated formation to be infed to a revolvingly driven or rotating support means or support disc. These printed products are placed upon this support means in a reclining position to form a spiral-shaped or helical stack. Such a prior art apparatus is, for example, described in German Patent Publication No. 2,518,374, which is cognate with the U.S. Pat. No. 4,274,623, granted June 23, 1981. It is possible with this prior art apparatus to form stable stacks of considerable height. These stacks are formed so that they can again be consumed, i.e. have their printed products removed, at a different location perhaps, after temporary storage. Due to weight considerations it is not possible to arbitrarily increase the height or the diameter of these stacks in order to correspondingly increase the storage capacity in this manner.

In order to withdraw or recuperate the printed products from such stacks, a special device is necessary which is constructed differently from the device for forming these stacks. This recuperation or withdrawal of printed products from the stack preferably takes place from below but, if necessary, can also take place from above. Direct access to the printed products in the inner portion of the stack is not possible and is also not intended, since such a stack usually contains as a rule only similar printed products and thus it is not necessary to withdraw or remove the printed products from any specific portion of the stack, such as the inner portion.

SUMMARY OF THE INVENTION

Therefore, with the foregoing in mind, it is a primary object of the present invention to provide a new and improved construction of an apparatus for storing printed products arriving in an imbricated formation which does not exhibit the aforementioned drawbacks and shortcomings of the prior art constructions.

Another and more specific object of the present invention aims at providing a new and improved construction of an apparatus of the previously mentioned type which is relatively simply designed and yet capable of storing a larger quantity of printed products than is possible in the prior art.

A further important object of the present invention aims at providing a new and improved construction of an apparatus of the previously mentioned type which allows more ready access to the stored printed products than is possible in the prior art.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that two or more, i.e. at least two support means or discoidal support elements or plates of the plurality of support means for the printed products are arranged substantially vertically above one another, i.e. substantially in superposition. These support means are revolvingly driven about a substantially upright or vertical axis of rotation. Each support means of the plurality of support means is connected with a winding drum or mandrel or core whose longitudinal axis extends substantially in the direction of the substantially upright axis of rotation of the plurality of support means. The plurality of support means and the winding core form or conjointly define a winding unit. The winding units are individually rotatably driven and individually infed or loaded with printed products to be wound upon the related winding core or the like. The conveying or delivery arrangement is designed such that the printed products can be fed in a substantially vertical or upright position or orientation to the individual winding cores, or to the respective wound product package or storage coil being formed thereon with at least one face or side of the printed products confronting the individual winding cores or the respective individual wound product packages wound thereon, as the case may be.

The arrangement of the winding units one above another into a tower-like or column-like formation or structure, i.e. in superposition, permits the storage of a very large quantity of printed products with optimal utilization of the space occupied. This is possible, on the one hand, because it is possible to produce wound product packages or storage coils of very large diameter with correspondingly large storage capacity by winding or coiling up the printed products in a standing or upright position and by supporting the printed products on the support member. On the other hand, the spacing or distance between adjacent winding units is substantially dependent only upon the height of the printed products. Even when utilizing winding cores of relatively large diameter, which has the advantage of a less pronounced bending of the printed products of the innermost windings of the wound product package, it is not necessary to accept a substantial reduction of storage capacity since, for the aforesaid reasons, wound product packages with large diameters can be formed.

Since the individual winding units can be individually driven and individually loaded or infed with printed products, it is possible to store printed products of different types in the different winding units. Free access to the printed products stored in the different winding units is selectively possible at any time.

The vertical or upright edge of the printed products wound upon the winding core is supported by the associated support means or element. It is thus sufficient for preventing the disintegration of the wound product package or storage coil to support the printed products on their outer side at the currently outermost winding. For this purpose, an elongated flexible support element, for example a support strap or band, can be utilized which is connected with the winding core. This support element is coiled or wound up with the imbricated product formation and is subject to a very low tension or tensile force.

The removal or withdrawal of the printed products from the individual winding units can be accomplished substantially with the help of the delivery conveyor or arrangement which, for this purpose of product removal or withdrawal, is rotatably driven in the opposite direction. For satisfactory delivery or feeding of the printed products, which are separated from the winding core or the respective wound product package formed thereon, to the removal or withdrawal conveyor or arrangement, it is advantageous to also coil or wind up a partitioning or separating element, for example a partitioning or separating band or strap, during the previous winding or coiling up process of the imbricated product formation. This partitioning or separating element is wound upon the side of the imbricated product formation which confronts the winding core. The imbricated product formation arranged between the support element and the partitioning element is guided or fed by these two elements during the unwinding or uncoiling operation.

A preferred embodiment of the inventive apparatus is provided with a delivery conveyor or arrangement which is common to all winding units and which comprises an adjustable end portion or section which is adjustable in height and also in a direction transverse to the axis of rotation of the winding units. This adjustable end portion or section of the delivery conveyor or arrangement serves to deliver the imbricated product formation to the winding cores or to the respective wound product packages formed thereon.

This end portion or section of the delivery conveyor or arrangement preferably is a rocker or pivoting conveyor comprising at least one upright or substantially vertical axis and is capable of being pivoted about this axis. This rocker or pivoting conveyor preferably comprises two band or strap conveyors which form therebetween a conveyor gap or channel.

Furthermore, this end portion or section is arranged following or downstream of to a circulatingly driven delivery conveyor or arrangement. This circulatingly driven delivery conveyor comprises a section which extends substantially parallel to the axis of rotation of the winding units and an exit or discharge region which is adjustable in height.

It is advantageous to provide the delivery conveyor or arrangement with a turning device for pivoting or turning the reclining imbricated product formation about its longitudinal axis through an angle of, for example, 90°. This turning device is preferably positioned prior to or upstream of the end portion or section of the delivery conveyor or arrangement.

A particularly simple design of the inventive apparatus provides a drive means for all winding units which is adjustable in elevation or height conjointly with the end portion or section of the delivery conveyor or arrangement and which can be selectively coupled with the individual winding units.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
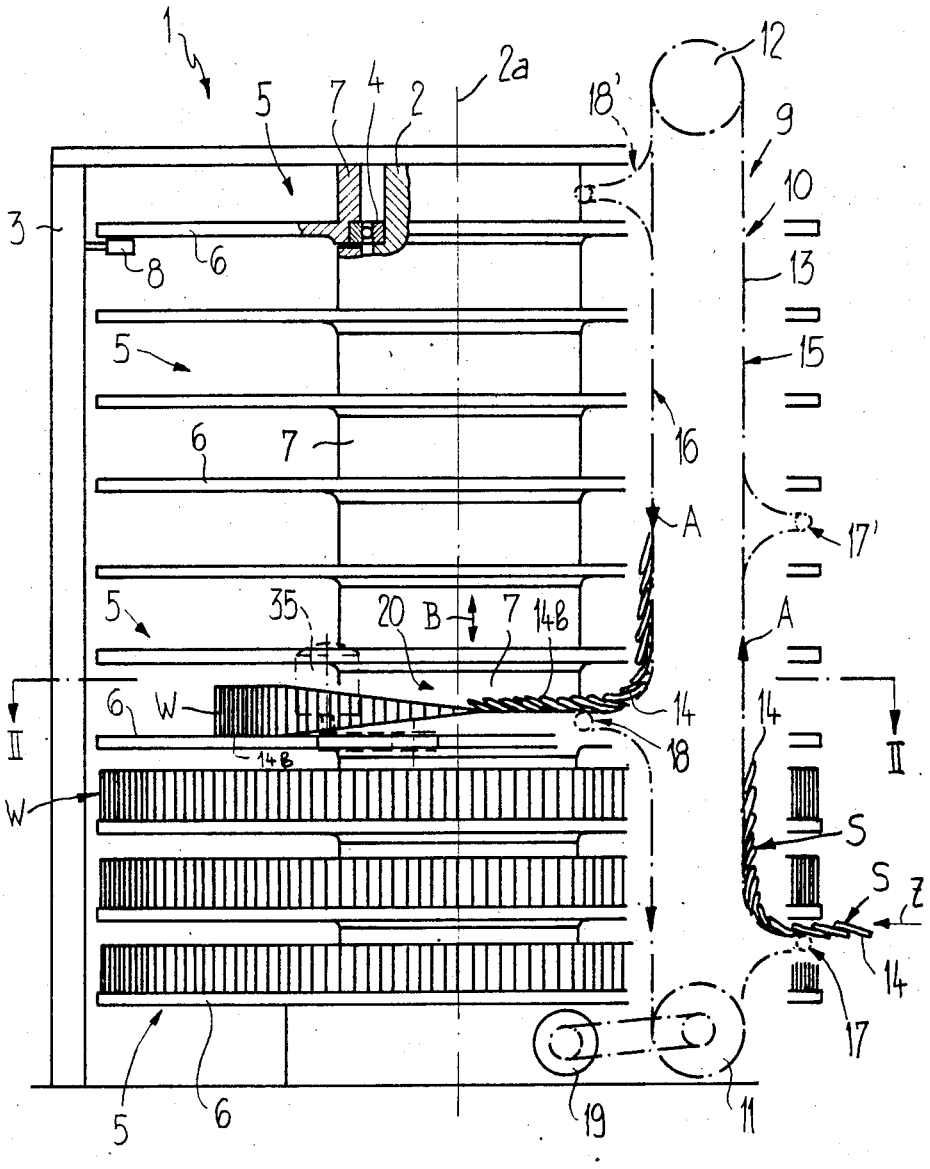
FIG. 1 is a schematic illustration in side view and partial section of an apparatus for storing printed products, showing the operation of storing the printed products.

Describing now the drawings, it is to be understood that to simplify the showing thereof only enough of the structure of the apparatus for storing printed products arriving in an imbricated formation and for unwinding the stored printed products has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a tower-like or column-like apparatus or storage apparatus 1 for storing printed products. This storage apparatus 1 comprises a central support column 2 as well as load-bearing support columns 3 arranged around or about this central support column 2. A plurality of winding units 5 are rotatably mounted by means of radial and axial thrust bearings 4 mounted on the central support column 2. The individual winding units 5 are arranged over or above each other, i.e. in substantial superposition and are individually and independently rotatable about a common upright, preferably substantially vertical axis of rotation *2a*.

Each winding unit 5 comprises a discoidal support element or plate 6 or equivalent support structure or means arranged in a transverse or substantially horizontal position as well as an annular winding mandrel or drum or core 7 which is connected with the discoidal support element or plate 6. The longitudinal axis of the annular winding mandrel or drum or core 7 substantially coincides with the common vertical axis of rotation *2a*. The winding mandrels or drums or cores 7 are located on the upper sides of the respective discoidal support elements or plates 6. The discoidal support elements or plates 6 are supported at their circumferences by means of support rollers or rolls 8. The support rollers or rolls 8 are fastened to the load-bearing support columns 3. Only one of the support rolls or rollers 8 is illustrated in FIG. 1.

Arranged laterally of the winding units 5 is a delivery conveyor or arrangement 9 which is common to all winding units 5. This delivery conveyor or arrangement 9 comprises a conveyor 10 whose design may correspond to the conveyor shown in the German Patent Publication No. 2,644,906, which is cognate with the U.S. Pat. No. 4,062,537, granted Dec. 13, 1977, and the disclosure of which is incorporated herein by reference.

The conveyor 10 comprises two endless chains 13 or similar means which are only schematically illustrated in FIG. 1 and which travel over deflection wheels 11 and 12 and upon which suitable grippers or clamps, which are not particularly illustrated in FIG. 1, are attached. These grippers or clamps engage or grip printed products 14 fed in an imbricated formation or imbricated product formation S in the direction of the arrow Z (cf. FIG. 1) and entrain or carry these printed products 14 in the direction of conveyance A of the conveyor 10.

The conveyor 10 comprises two sections or runs 15 and 16 which extend substantially vertically, that is to say substantially parallel to the common upright or substantially vertical axis of rotation 2*a* of the winding units 5. The section or run 15 is provided with a transversely or substantially horizontally extending entrance or deposition section 17 while the other section or run 16 comprises a likewise transversely or substantially horizontally extending exit or discharge area or section 18 which is adjustable in height, that is to say which can be elevated or moved in the direction of the double-headed arrow B (cf. FIG. 1) as is described in more detail in the previously mentioned German Patent Publication No. 2,644,906.

As will be described later, these two sections 17 and 18, which are shown in FIG. 1 as an insertion or deposition section 17 and a discharge section 18, can, for product withdrawal or removal, be utilized as respective discharge sections in the reverse direction, that is to say operated in a direction away from the storage apparatus 1.

In FIG. 1 reference numeral 18' describes the exit or discharge area or section 18 located in its uppermost position. The entrance or insertion section 17 likewise can be designed to be adjustable in height or elevation. A different position of this entrance or insertion section 17 is indicated by reference numeral 17'. The conveyor 10 is driven by means of a suitable drive or drive means 19 which is only schematically illustrated. This drive or drive means 19 is appropriately drive-connected with the deflection wheel 11.

A turning or rotating device 20 is arranged subsequent to the conveyor 10 and adjacent to the exit or discharge section 18 of the conveyor 10 and is only schematically illustrated in the figures of the drawings. This turning device 20 serves to position or raise the reclining or substantially horizontally delivered printed products 14 into an upright or substantially vertical position or orientation, that is to say, to turn or twist or rotate the imbricated product formation S through a predeterminate angle, for example through 90°, about its longitudinal axis.

During this vertical alignment or raising or positioning of the printed products 14, a side 14*b* of the printed products 14 which was the upper side in the infed imbricated product formation S bears against or confronts the winding core 7. The turning device 20 can be formed, for example, by means of two opposing or confronting conveyor straps or bands. These two conveyor straps or bands accommodate the imbricated product formation S therebetween and guide the imbricated product formation S over not particularly illustrated deflection rollers such that they turn or rotate the imbricated product formation S as previously described.

The imbricated product formation S, which is infed or delivered by means of the conveyor 10, can also conceivably be gripped at its side edges by means of grippers or clamps. These grippers or clamps are fastened or connected to a chain or similar structure which is guided such that the entrained or engaged or gripped imbricated product formation S is twisted or turned through a predeterminate angle, for example through an angle of 90°.

Figure 2:
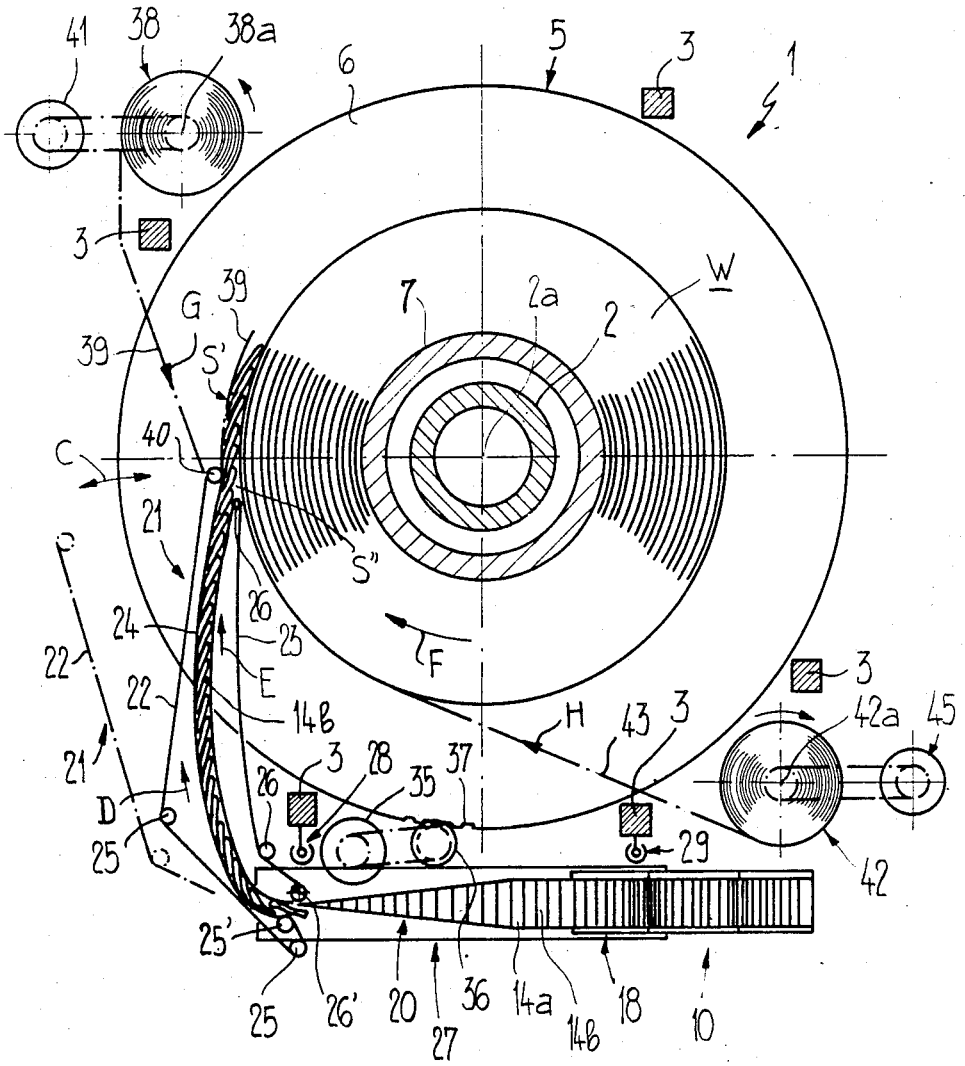
FIG. 2 is a section of the apparatus shown in FIG. 1 taken along the line II—II in FIG. 1.
Figure 3:
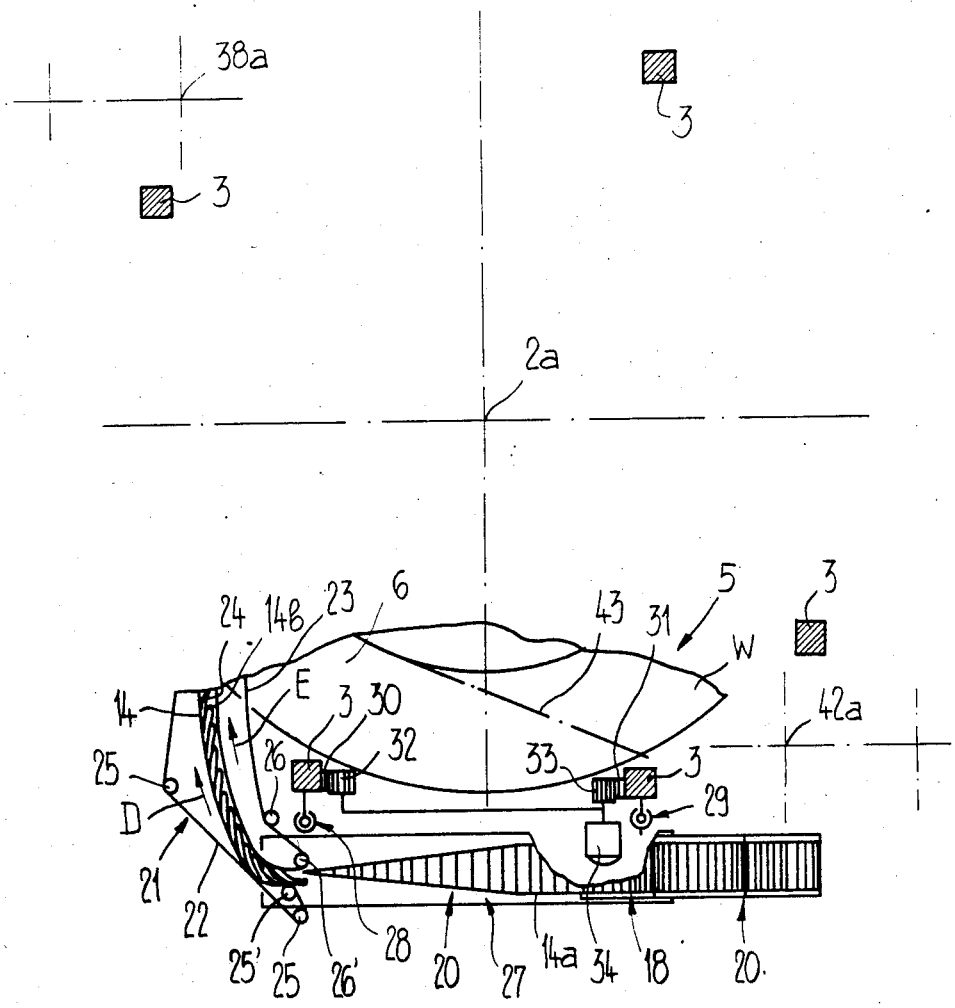
FIG. 3 is an illustration analogous to FIG. 2 showing the end portion or section of the delivery conveyor or arrangement which is adjustable in elevation.
Figure 4:
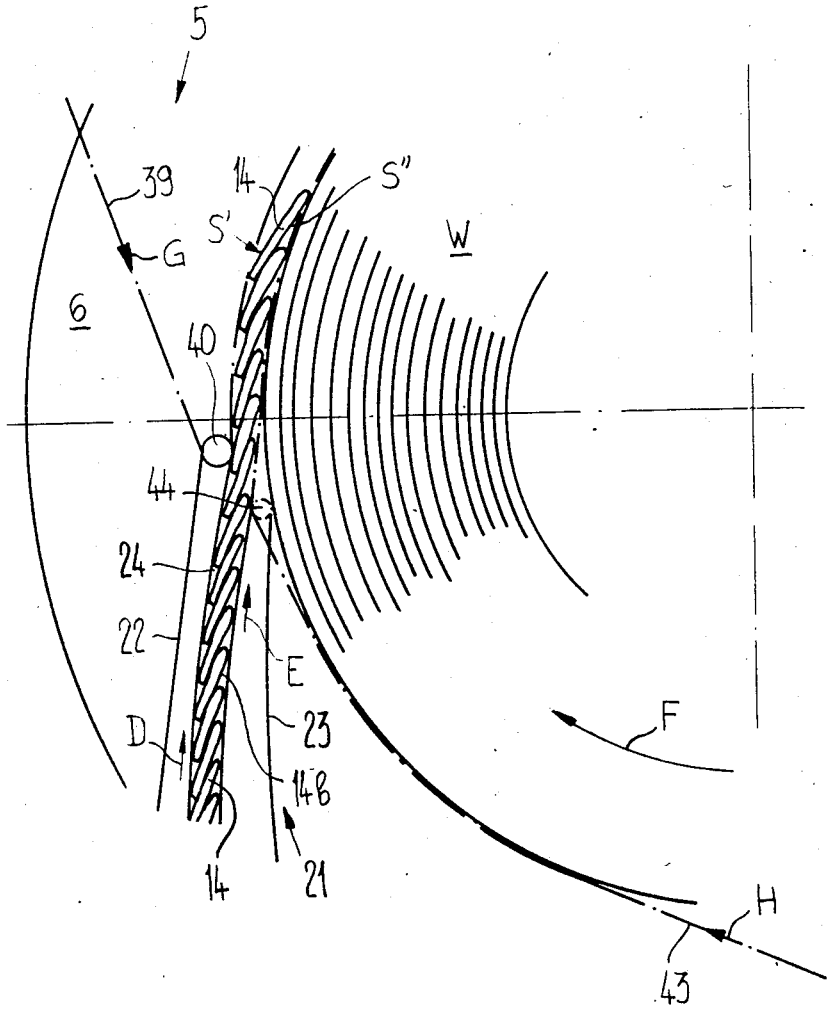
FIG. 4 is a top plan view analogous to FIG. 2 of the region in which the printed products are wound onto the wound product package or storage coil.

As illustrated in FIGS. 2 through 4, an end portion, for example a rocker conveyor or pivoting or swinging conveyor 21, is adjacently connected to the turning device 20. This rocker conveyor 21 comprises two conveyor belts or bands or straps 22 and 23. These conveyor belts 22 and 23 form between themselves a conveyor gap or channel 24 for the uprighted or raised or substantially vertically positioned or oriented printed products 14 as previously described. Both conveyor belts 22 and 23 are appropriately rotatingly driven in a manner which is not here particularly shown in the direction of the arrows D and E, respectively.

The conveyor belts 22 and 23 are guided over deflection rollers or rolls 25 and 26, respectively, and are pivotable about axes 25' and 26', respectively, of two deflection rollers or rolls (not particularly referenced in the figures) in the direction of the double-headed arrow C (cf. FIG. 2). The turning device 20 as well as the rocker conveyor 21 are adjustable in elevation or height conjointly with the exit or discharge area 18 of the conveyor 10.

The exit or discharge area 18, the turning device 20 and the rocker conveyor 21 and the respective deflection rolls or rollers 25 and 26 determining the respective pivot axes 25' and 26' of the conveyor belts 22 and 23 are, for this purpose, attached to an elevatable support or support means or structure 27 (cf. FIGS. 2 and 3). This elevatable support 27 is guided in the upright or vertical direction by means of guides or guide means 28 and 29 connected to two of the load-bearing support columns 3. Toothed or gear racks 30 and 31 are attached to the aforementioned two load-bearing support columns 3 (cf. FIG. 3) and mesh or engage with respective pinions 32 and 33. Both pinions 32 and 33 are driven by a drive or drive means 34 which is attached to the elevatable support 27. This drive or drive means 34 is preferably a transmission braking motor.

A drive means or drive motor 35 is further connected to the elevatable support 27 for driving a pinion 36. This pinion 36 is rotatably or pivotably connected with the elevatable support 27 (cf. FIG. 2). This pinion 36 can mesh or can be brought into engagement with respective tooth elements or gear toothing 37 at the circumference of a respective discoidal support element or plate 6. By means of this drive means or drive motor 35 and the pinion 36 which engages the respective tooth elements or toothing 37, the corresponding winding unit 5 can be rotated or rotatably driven in the wind-up or coil-up direction F (cf. FIGS. 2 and 4).

Each winding unit 5 is associated with a supply reel or roll 38 for a flexible support element, for example, a support band or strap 39, which is connected with the winding core 7. This support element or band or strap 39 is guided over a deflection roll or roller 40 (cf. FIG. 4) which is positioned at the exit or discharge area of the outerlying or outer conveyor belt 22. This deflection roll or roller 40 is mounted separately from the conveyor belt 22 at a pivot arm which is not particularly illustrated in FIG. 4. The support element or band or strap 39 rests on an outerlying or outer side S' of the imbricated product formation S and is rolled or coiled up with this imbricated product formation S. The supply roll or reel 38 rotates in a counter-clockwise direction and is lightly braked or retarded by means of a braking drive means 41.

Each winding unit 5 is further associated with a supply roll or reel 42 which is provided for a flexible partitioning or separating element, for example an elongated flexible partitioning strap or band 43, which is likewise connected with the winding core 7. This partitioning strap 43 travels over a guide roll or roller 44 (cf. FIG. 4) arranged at the exit or discharge region of the innerlying or inner conveyor belt 23, i.e., the conveyor belt 23 which lies nearest the winding core 7 or wound product package W formed thereon. The partitioning strap or band 43 travels on the inner side S'' of the imbricated product formation S which is nearest the winding core 7 or wound product package W and is likewise wound or coiled up with the imbricated product formation S. The supply reel or roll 42 which is rotating in a clockwise-direction is lightly braked or retarded by means of a braking drive means 45.

The process of feeding or loading or conveying the printed products 14 to the storage apparatus 1 is described hereinbelow.

The elevatable support 27, together with the component parts connected thereto, i.e. the exit or discharge region or section 18, the turning device 20, the rocker conveyor or pivoting conveyor 21, the drive means or drive motor 35 and the pinion 36, is raised or lowered in the direction of the double-headed arrow B to the height or elevation of the respective winding unit 5 to be loaded or infed or delivered with printed products 14 by operating the drive means or drive motor 34. A pivoting or rotating mechanism which is not particularly illustrated in the figures of the drawings, is provided for pivoting the rocker conveyor or pivoting conveyor 21 in the direction of the double-headed arrow C which is towards the winding core 7.

The printed products 14 to be wound upon the winding core 7 which are received or taken over from the conveyor 10 in the entrance or insertion section 17 are fed by means of the conveyor 10 to the turning device 20. By this means the printed products 14 are uprighted or placed in a substantially vertical position or orientation. These printed products 14 are subsequently fed to the winding core 7, or the respective wound product package or storage coil W formed thereon, by means of the conveyor bands or belts 22 and 23 of the rocker conveyor or pivoting conveyor 21.

The printed products 14 exiting from the conveying channel or gap 24 of the rocker conveyor or pivoting conveyor 21 arrive or are admitted between the support band or strap 39 and the partitioning or separating band or strap 43 and are wound or coiled up with this support band or strap 39 and partitioning or separating strap or band 43. The support band 43 and the separating band 43 are uncoiled or unwound in the direction of the respective arrows G and H from the respective supply reels or rolls 38 and 42 onto the winding core 7.

The same sides **14*b* of the printed products 14 which were on the top or upper portion of the incoming imbricated product formation S are confronting or facing the winding core 7. The upright or substantially vertically positioned wound or coiled printed products 14 come to rest on the discoidal support element of plate 6 with their side edges which are designated by the reference numeral 14*a*. The discoidal support element or plate 6 supports the weight of the wound product package or storage coil W. The support band or strap 39 which is located at the outer side of the outermost winding of the wound product package or storage coil W prevents a tipping-over of the upright or vertically positioned printed products 14**.

When a wound product package or storage coil W is completely formed, the delivery or infeed of the printed products 14 is interrupted, the rocker conveyor or pivoting conveyor 21 is radially or outwardly pivoted away from the completed wound product package W in the direction of the arrow C and the elevatable support 27 is raised or lowered to the next winding unit 5 to be filled or loaded. A new wound product package or storage coil W is then formed in the same manner as previously described.

Figure 5:
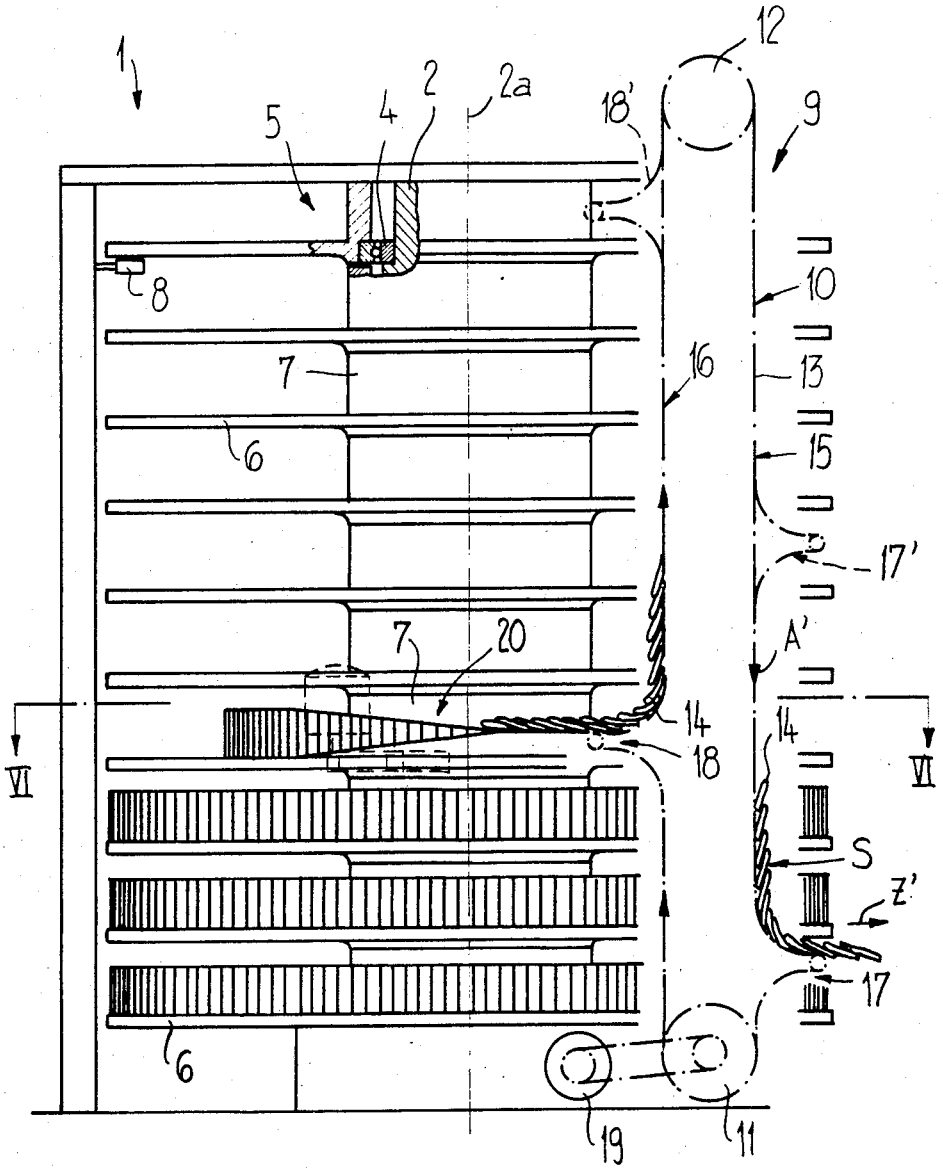
FIG. 5 is a view of the apparatus shown in FIG. 1 showing the operation of removing or withdrawing of the stored printed products.
Figure 6:
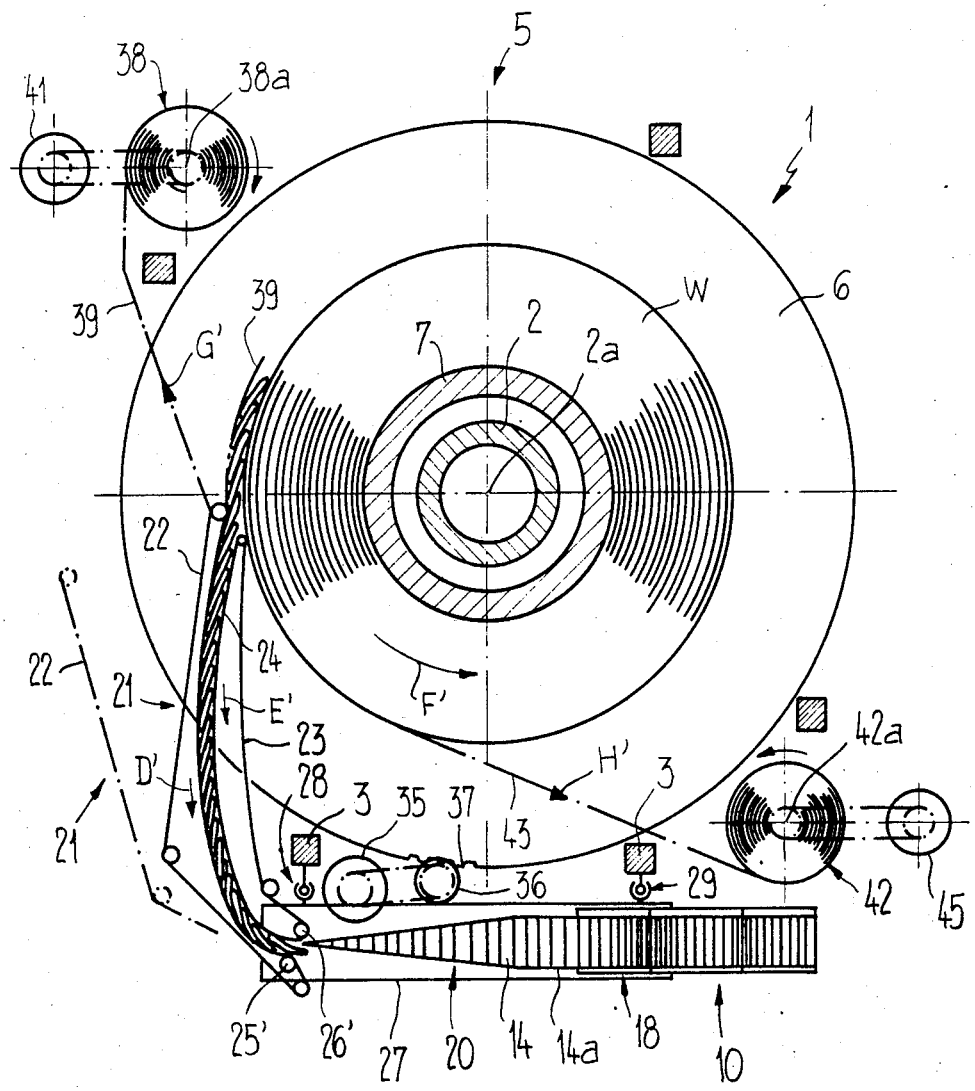
FIG. 6 is a section of the apparatus shown in FIG. 5 taken along the line VI—VI in FIG. 5.

The withdrawal or removal of the stored printed products 14 will now be described with reference to FIGS. 5 and 6, which Figures substantially correspond to FIGS. 1 and 2. It is pointed out that the same delivery conveyor or arrangement 9 is hereby utilized and is driven in a direction which is opposite to the direction in which the delivery conveyor or arrangement 9 is driven during the delivery or loading or infeed operation.

The elevatable support 27, together with the exit or discharge area or section 18 of the conveyor 10, the turning device 20 and the rocker conveyor or swinging conveyor 21, is raised or lowered to the elevation or height of the winding unit 5 to be emptied or unloaded. The rocker conveyor or swinging conveyor 21 is then pivoted substantially radially inwardly toward the wound product package W and brought to rest on or to bear against the wound product package W. The storage reels or rolls 38 and 42 are revolvingly or rotatably driven by means of the respective braking drive means 41 and 45 in respective clockwise and counter-clockwise directions about respective axes **38*a* and 42*a*. This results in the support band or strap 39 and the partitioning or separating strap 43 being uncoiled or unwound from the corresponding supply roll or reel 38 and 42** and thereby transported or displaced in the direction of the arrows G' and H', respectively.

The corresponding winding unit 5 is caused to revolve or rotate in the direction of the arrow F' by the unwinding or uncoiling process of both the support strap 39 and the partitioning strap 43 without the necessity of driving the wound product package W by means of the drive means or motor 35.

The printed products 14 are unwound or uncoiled from the wound product package W by this rotation of the winding unit 5 and are guided by means of the separating or partitioning band or strap 43 and are directed or fed into the conveying channel or gap 24 of the rocker conveyor or pivoting conveyor 21. The conveyor belts 22 and 23 which are rotatingly driven in the direction of the arrows D' and E', respectively, then bring the printed products 14 to the turning device 20. The turning device 20 places the upright or vertically aligned printed products 14 again in a reclining position and delivers the printed products 14 to the conveyor 10.

The conveyor 10 drives the unwound or uncoiled imbricated product formation S in the direction of the arrow A' and brings or transports the unwound imbricated product formation S to the horizontal entrance or insertion section 17, which is now functioning as an exit section as previously mentioned. The printed products 14 are transported away from the horizontal section 17 in the direction of the arrow Z' in a conventional manner which is not particularly here shown. The printed products 14 leaving the horizontal section 17 of the conveyor 10 can also be gripped or picked up by means of clamps or grippers of a conveyor whose direction of conveyance is from a lower position to a higher position. The printed products 14 can thus be conveyed or transported upwardly, that is to say can be raised or lifted away from the subsequent printed product 14.

When a winding unit 5 is empty, the elevatable support 27 is moved or elevated to the height of the next winding unit 5 to be emptied.

It is possible to receive and wind-up printed products from different delivery conveyors, or to transfer already wound-up printed products to different delivery conveyors 10 for removal, by elevating, that is to say by raising or lowering the height or elevation of the horizontal section 17. This means that a storage apparatus 1 can be infed or loaded from different sources and can transfer or deliver printed products to different further processing stations, respectively.

The individual winding units 5 can be loaded or unloaded, respectively, in a random sequence since each winding unit 5 can be operated or put into operation individually and independently of the other winding units 5.

The distance or spacing between the discoidal support elements or plates 6 of adjacent winding units 5 is primarily determined only by the height of the printed products 14 to be wound up or stored. If printed products of different heights are to be stored in a storage apparatus 1, then the distance or spacing between the individual discoidal support elements or plates 6 can be different.

The storage apparatus 1 previously described can also be designed differently with respect to its various components than as illustrated in the figures of the drawings and as described above. Only a few of the different variations possible will be mentioned in the following hereinbelow.

The turning or rotating or twisting of the imbricated product formation S about its longitudinal axis through an angle of, for example, 90°, can also be accomplished in the exit or discharge section 18 of the conveyor 10. In this situation a special turning device 20 is not necessary. A turning device 20 is also not necessary if the printed products 14 are already transported to the storage apparatus 1 in an upright or vertical position.

An individual, stationary drive or drive means can also be provided for each winding unit 5 for driving the individual winding units 5. A greater construction expenditure is naturally connected therewith as compared with the illustrated preferred embodiment of a single drive means 35 and pinion 36. The same applies if, rather than just one delivery conveyor or arrangement 9 being commonly provided for all winding units 5, each winding unit 5 is provided or associated with an individual delivery conveyor 9. A type of hybrid solution provides two or more delivery conveyors or arrangements 9 operating independently of each other, which then makes possible a simultaneous loading or, respectively unloading of a plurality of winding units 5.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for storing printed products having at least one face and arriving in an imbricated formation, comprising:

a plurality of support means for storing the printed products;

said plurality of support means having a substantially upright axis;

means for rotatably driving said plurality of support means about said substantially upright axis;

a delivery arrangement for delivering the printed products to said plurality of support means;

at least two support means of said plurality of support means being arranged substantially in superposition;

a respective winding core connected to each support means of said plurality of support means;

each said respective winding core having a longitudinal axis and defining conjointly with each connected one of said support means a winding unit;

said longitudinal axis of each said respective winding core extending substantially in the same direction as said substantially upright axis of said plurality of support means;

means for individually driving and individually loading each said winding unit with the printed products to be wound upon each said respective winding core for forming a wound product package on each said respective winding core; and said delivery arrangement being constructed for delivering the printed products in a substantially upright position to each said winding core and to each said wound product package forming thereupon such that said at least one face of the printed products confronts each said winding core and each said wound product package.

2. The apparatus as defined in claim 1, further including:

a common support column for said plurality of support means; and means for rotatably mounting each said winding unit about said common support column.

3. The apparatus as defined in claim 1, wherein:

each said winding unit comprises a supply reel;

each said supply reel of said winding unit comprising an elongated flexible support element attached to said respective winding core of each said winding unit and being capable of being uncoiled from said supply reel; and said elongated flexible support element being capable of being continuously coiled up on an outer side of the imbricated formation.

4. The apparatus as defined in claim 3, wherein:

said elongated flexible support element comprises a strap.

5. The apparatus as defined in claim 3, wherein:

each said winding unit comprises a further supply reel;

each said further supply reel comprising an elongated flexible partitioning element attached to said respective winding core of each said winding unit and capable of being uncoiled from said further supply reel; and said elongated flexible partitioning element being capable of being continuously coiled up on an inner side of the imbricated formation.

6. The apparatus as defined in claim 5, wherein:

said elongated flexible partitioning element comprises a strap.

7. The apparatus as defined in claim 1, wherein:

said delivery arrangement is common to all said winding units;

said delivery arrangement comprising an end portion for delivering the imbricated formation to each said respective winding core and each said wound product package forming thereon; and said end portion being capable of being adjusted in a direction substantially parallel with respect to said longitudinal axis of each said respective winding core and in a direction transverse to said substantially upright axis of each said support means.

8. The apparatus as defined in claim 7, wherein:

said end portion comprises a rocker conveyor; and said end portion having at least one substantially upright axis and being capable of being pivoted about said at least one substantially upright axis.

9. The apparatus as defined in claim 8, wherein:

said rocker conveyor comprises two conveyor straps; and said two conveyor straps forming a conveyor channel therebetween.

10. The apparatus as defined in claim 7, wherein:

said delivery arrangement includes a circulatingly driven conveyor arranged upstream of said end portion;

said circulatingly driven conveyor comprising a section which is substantially parallel to said substantially upright axis of said plurality of support means;

said section of said circulatingly driven conveyor comprising an exit section; and said exit section being adjustable in height.

11. The apparatus as defined in claim 1, wherein the imbricated formation comprises a reclining imbricated formation having a longitudinal axis and wherein:

said delivery arrangement comprises a turning device for turning said reclining imbricated formation through an angle of substantially 90° about said longitudinal axis and thereby uprighting the printed products.

12. The apparatus as defined in claim 11, wherein:

said delivery arrangement comprises an end portion; and said turning device being arranged upstream of said end portion of said delivery arrangement.

13. The apparatus as defined in claim 12, further including:

a pinion;

a drive means coacting with said pinion for driving each said winding unit;

said drive means, said pinion and said end portion being conjointly adjustable in height; and said drive means and said pinion being capable of being coupled to a predetermined one of said winding units.

14. The apparatus as defined in claim 1, wherein the imbricated formation is capable of being unwound by means of each said winding unit and wherein:

each said winding unit having a first predetermined direction of rotation for winding up the imbricated formation and a second predetermined direction of rotation opposite to said first predetermined direction of rotation for unwinding the imbricated formation.

15. The apparatus as defined in claim 1, wherein:

each said winding unit comprises a supply reel containing an elongated flexible support element and a further supply reel containing an elongated flexible partitioning element; and means for driving said supply reel and said further supply reel for unwinding said elongated flexible support element and said elongated flexible partitioning element.

16. The apparatus as defined in claim 1, further including:

means for circulatingly driving said delivery arrangement in a direction which is opposite to a predetermined direction for delivering the printed products.

* * * * *